US008051613B2

(12) United States Patent
Lu et al.

(10) Patent No.: US 8,051,613 B2
(45) Date of Patent: Nov. 8, 2011

(54) COMBINED WALL PANEL

(76) Inventors: Chen-Yin Lu, Tainan (TW);
Ying-Chung Lan, Tainan (TW)

( * ) Notice: Subject to any disclaimer, the term of this patent is extended or adjusted under 35 U.S.C. 154(b) by 379 days.

(21) Appl. No.: 12/336,973

(22) Filed: Dec. 17, 2008

(65) Prior Publication Data

US 2010/0146884 A1 Jun. 17, 2010

(51) Int. Cl.
*E04C 2/52* (2006.01)

(52) U.S. Cl. ..... 52/220.2; 52/220.3; 52/220.1

(58) Field of Classification Search ..... 52/302.1, 52/220.3, 578, 576, 220.2, 220.1, 302.4, 52/795.1, 794.1, 790.1, 783.1, 302.3
See application file for complete search history.

(56) References Cited

U.S. PATENT DOCUMENTS 3,387,420 A * 6/1968 Long ..... 52/302.3
4,850,165 A * 7/1989 Ohern ..... 52/199
5,477,969 A * 12/1995 Beeskau et al. ..... 211/90.02
5,499,476 A * 3/1996 Adams et al. ..... 52/220.1
6,076,315 A * 6/2000 Kondo ..... 52/220.1
6,164,026 A * 12/2000 Ehrenkrantz ..... 52/220.2
6,293,062 B1 * 9/2001 Chen ..... 52/220.1
6,457,288 B2 * 10/2002 Zambelli et al. ..... 52/220.2
6,526,710 B1 * 3/2003 Killen ..... 52/220.1
6,598,366 B2 * 7/2003 Hsieh et al. ..... 52/506.01
7,594,365 B2 * 9/2009 Kang et al. ..... 52/220.2

* cited by examiner

*Primary Examiner* — Brian Glessner
*Assistant Examiner* — Beth Stephan
(74) *Attorney, Agent, or Firm* — WPAT, P.C.; Anthony King

(57) ABSTRACT

A combined wall panel is composed of a plurality of main body boards. The specific base angle on said main body board wherein longitudinal and transverse grooves are provided at equal distance so as to form a protruding square brace block; a first longitudinal and transverse grooves are provided respectively from said base angle at a translational distance of a second unit length, the last longitudinal and transverse grooves is positioned at a distance of a third unit length to said second long and short sides, while remanding longitudinal and transverse grooves are provided successively at an equal interval of a first unit length between the first longitudinal and transverse grooves and the last longitudinal and transverse grooves; wherein said main body board is provided further from said base angle with longitudinal and transverse splicing joining faces having a fourth unit width, and wherein said main body board is provided further on part of said brace blocks as well as longitudinal and transverse joining faces with through holes penetrating through the thickness of said main body board.

15 Claims, 14 Drawing Sheets

COMBINED WALL PANEL

BACKGROUND OF THE INVENTION

1. Field of the Invention

The invention relates to a combined wall panel, and in particular, to a combined wall panel structure applicable in space design, characterized in that it is a continual wall composed of a plurality of simple main body boards, thereby to achieve spatial dividing effect, and that can be constructed simply and continuously.

2. Description of the Prior Art

It is well-known that residence is a primary demand for human living, and at any given time and location, most of human behaviors need a certain place to provide a site for living or working.

Speaking of residing space, mankind had concept of spatial planning at a very early age. As required in living or working situations, and in consideration of space saving or beautification, mankind would, most likely, carry out a suitable spatial planning to the living space.

For spatial planning, good partition wall panel structures are indispensable products in practice, for example, early conventional brick wall structure, a light partition system based on C channel steel and hard board cover, a system formed by grouting light concrete in a light partition, a metallic channel combination system and the like.

Most of the above-mentioned structures could achieve a certain structural strength and construction quality to provide a rigorous living space. However, partition wall structures mentioned above still had many disadvantages as followed for example:

1. Difficult to practice. Workers for the above-mentioned practices need a long-term special training and should combine with a long period of real experience to be able to get good construction quality.

2. Slow working. By way of an example, a brick wall structure needs to lay every brick together slowly and then reinforces with cement. Further, constructing process like C channel steel has to additionally fix main beam and pillar in advance by way of various operations such as binding, bolting, soldering and the like, and finally, grouting or filling with other materials. This process is quite tedious.

3. Difficult to pipe. Pipes including water and electric pipes necessary for living needs to be laid generally through damaging a part of the wall which is to be make up only after the work is completed. This process would affect inevitably the working time and quality, and further, the subsequent maintenance is not easy.

4. Expensive cost. Great increase in operation cost may be caused unavoidably by complicated material distributions, cleaning up and transporting on working place, long-term time cost, and employment of specialized operators.

In view of the disadvantages associated with the practical application of the above-described conventional partition walls, the inventors had studied intensively based on the experience accumulated in developing practice in relative industry for many years, and finally, had developed a combined wall panel structure according to the invention.

SUMMARY OF THE INVENTION

One object of the invention is to provide a combined wall panel by designing a structurally simple main body board, and constructing various wall panels by combining said main body boards.

Another object of the invention is to provide a combined wall panel, wherein said main body boards can be mass produced in a factory, and then can be transported to working places and assembled thereat as required, wherein the operation is simple and fast, operators can proceed the practice merely after a simple training, and further, no excess wastes or accumulated materials would be produced in the working places, which is desirable for the management and sanitation of the working places.

Still another object of the invention is to provide a combined wall panel, characterized in that, after the wall panel is assembled, the pipe channels will be formed naturally within the wall panel, thereby not only facilitates the laying of water and electrical pipes, but also is convenient for future maintenance and renewal.

The combined wall panel that can achieve the above-described objects according to the invention comprises a plurality of main body boards, each of said main body boards is a rectangular solid whose length is an integral factor of its width, and its width is greater than its thickness. Each of said main body boards has a specific base angle, wherein a first long side and a first short side connect with said base angle, and a second long side and a second short side are provided on the edges of said main body board opposite to said first long side and said first short side. A plurality of longitudinal grooves parallel to the short side are provided from said base angle along the first long side, and a plurality of transverse grooves parallel to the long side are provided from said base angle along the first short side in a way that said longitudinal grooves and transverse grooves are perpendicular and intersected with one another, as well as said longitudinal grooves and transverse grooves penetrate through the periphery of the main body board. The first longitudinal groove is provided from said base angle at a translational second unit length to the first short side, and remanding longitudinal grooves are provided successively from said first longitudinal groove at equal intervals of a first unit length, while the last longitudinal groove is positioned at a distance of a third unit length from the second short side. The first transverse groove is provided from said base angle at said translational second unit length to the first long side, remanding transverse grooves are provided successively from said first transverse groove at an equal interval of said first unit length, while the last transverse groove is positioned at a distance of said third unit length to the second long side. Protruding square brace blocks surrounded by longitudinal grooves and transverse grooves are formed on said main body board. Said main body board is provided separately from said base angle with equal width longitudinal splicing joining face parallel to the first long side and having a fourth unit width, and provided from said base angle with equal width transverse splicing joining face parallel to the first short side and having a fourth unit length, in a way that said equal width longitudinal and transverse splicing joining faces are overlapped at the base angle, as well as regions of said equal width longitudinal and transverse splicing joining faces are overlapped and shared with the region formed by the second unit width. Said main body board is provided further on part of the brace block and equal width longitudinal and transverse splicing joining faces with through holes penetrating said main body board in the direction of thickness.

Through holes of two thus-finished are positioned flush with each other by fixing specific position of these main body boards flush with each other, such that longitudinal and transverse grooves of two main body boards form a duct, wherein the region formed by the second unit width of one of the main body boards will overlap on the longitudinal and transverse splicing joining face of another main body board so as to expose longitudinal and transverse splicing joining faces of these two main body boards and hence facilitate the continuous building up of the wall face.

Said main body boards are classified into two forms as the first main body board and the second main body board. Said two main body boards have the same size, and each pair of their longitudinal and transverse grooves, brace blocks, longitudinal and transverse splicing joining faces, and through holes are positioned in mutual mirror manner, respectively. During assembling, one first main body board can be matched with one second main body board, or two first main body boards can be matched with two second main body boards.

BRIEF DESCRIPTION OF THE DRAWINGS

These features and advantages of the present invention will be fully understood and appreciated from the following detailed description of the accompanying drawings, wherein.

DETAILED DESCRIPTION OF THE PREFERRED EMBODIMENT

Referring to the accompanying drawings, the combined wall panel provided according to the invention comprises a plurality of main body boards, and is characterized in that, by assembling said plurality of main body boards, a wall panel structure having water and electrical pipes embedded therein can be formed.

Figure 1:
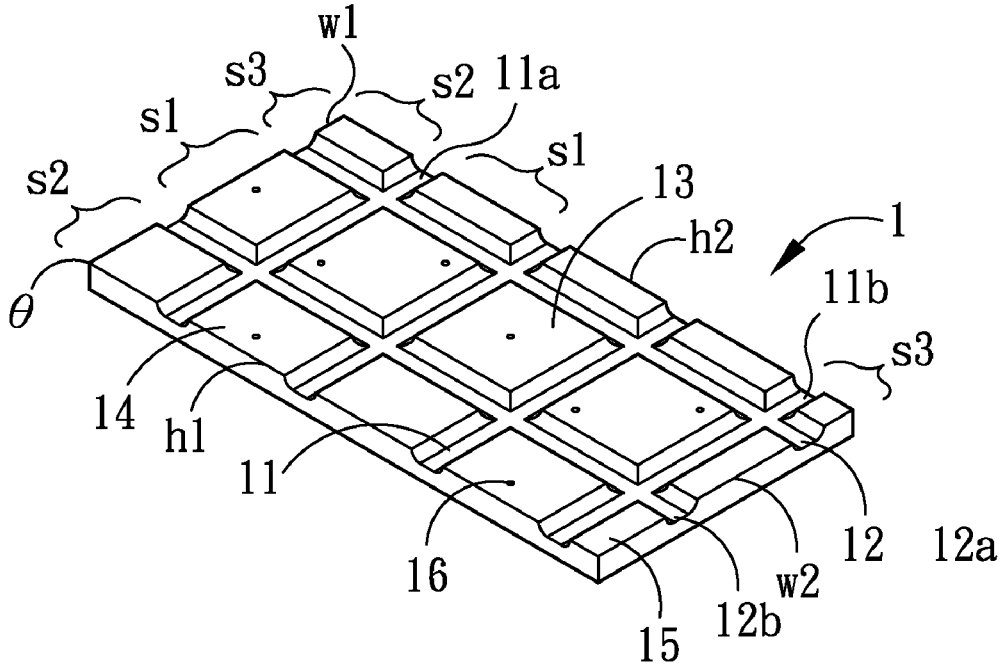
FIG. 1 is the pictorial view of the structure of the inventive first main body board.
Figure 2:
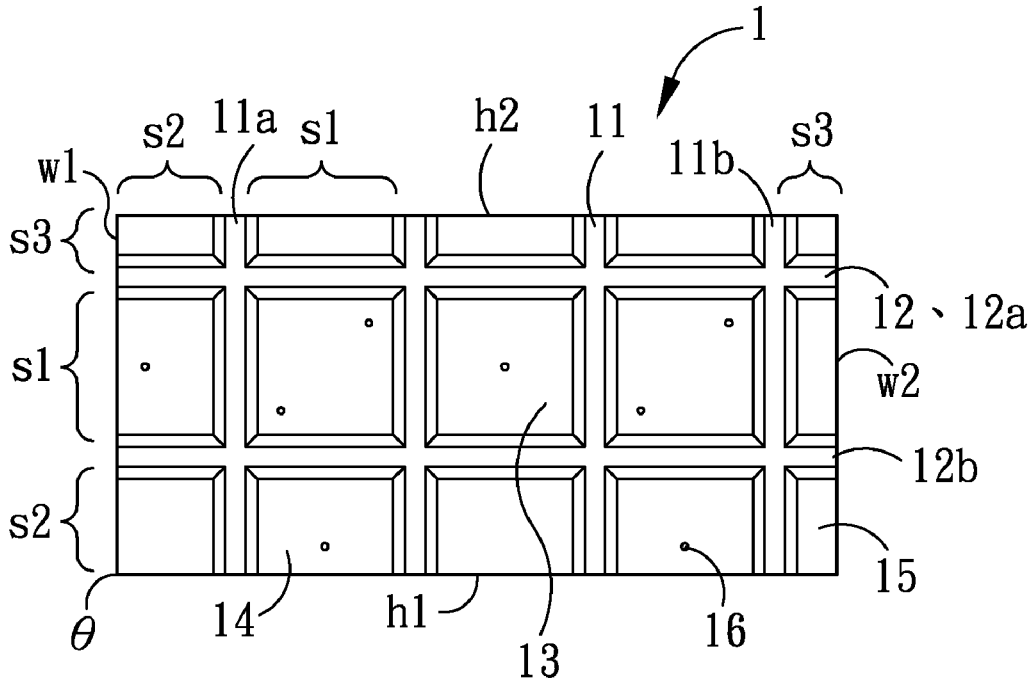
FIG. 2 is the plane view of the structure of said main body board.

The above-mentioned main body boards comprise a first main body board 1 and a second main body board 2. The first main body board 1 has a structure as shown in FIGS. 1 and 2, a rectangular solid. Said first main body board 1 has a length several integral times to its width, and the width is greater that its thickness. Said first main body board 1 has its one angle assigned as base angle θ. For the convenience of description, in one preferred embodiment, said base angle θ is provided at left lower angle of the first main body board 1. Sides of said first main body board 1 forming said base angle θ are a first long side h1 and a first short side w1, and a second long side h2 and a second short side w2 are provided on the edges of the first main body board 1 opposite to said first long side h1 and first short side w1. A plurality of longitudinal grooves 11 are provided from said base angle θ along the first long side h1 and parallel to the short side, and meanwhile, a plurality of transverse grooves 12 are provided from said base angle θ along the first short side w1 and parallel to the long side, in a manner that said longitudinal grooves 11 and transverse grooves 12 are perpendicular and intersected with one another, as well as said longitudinal grooves 11 and transverse grooves 12 penetrate through the peripheries of the first main body board 1, respectively. Said longitudinal and transverse grooves 11 and 12 are used mainly as ducts to accommodated water and electrical pipes or wires, while bottoms of said ducts are configured as slants or semi-circular lead angle.

The first longitudinal groove 11*a* is provided from said base angle θ at an translational distance of a second unit length s2 to the first short side w1, and the remanding longitudinal grooves 11 are provided successively from said first longitudinal groove 11*a* at an equal interval of a first unit length s1, while the last longitudinal groove 11*b* is positioned at a distance of a third unit length s3 away from the second short side w2. Similarly, a first transverse groove 12*a* is provided from said base angle θ at an translational distance of a first long side h1 to said second unit length s2, remanding transverse grooves 12 are provided successively from said first transverse groove 12*a* at an equal interval of said first unit length s1, while the last transverse groove 12*b* is positioned at a distance of said third unit length s3 to the second long side h2. In such a manner, a protruding square brace block 13 surrounded by longitudinal grooves 11 and transverse grooves 12 is formed within the inner side of said first main body board 1.

Figure 3:
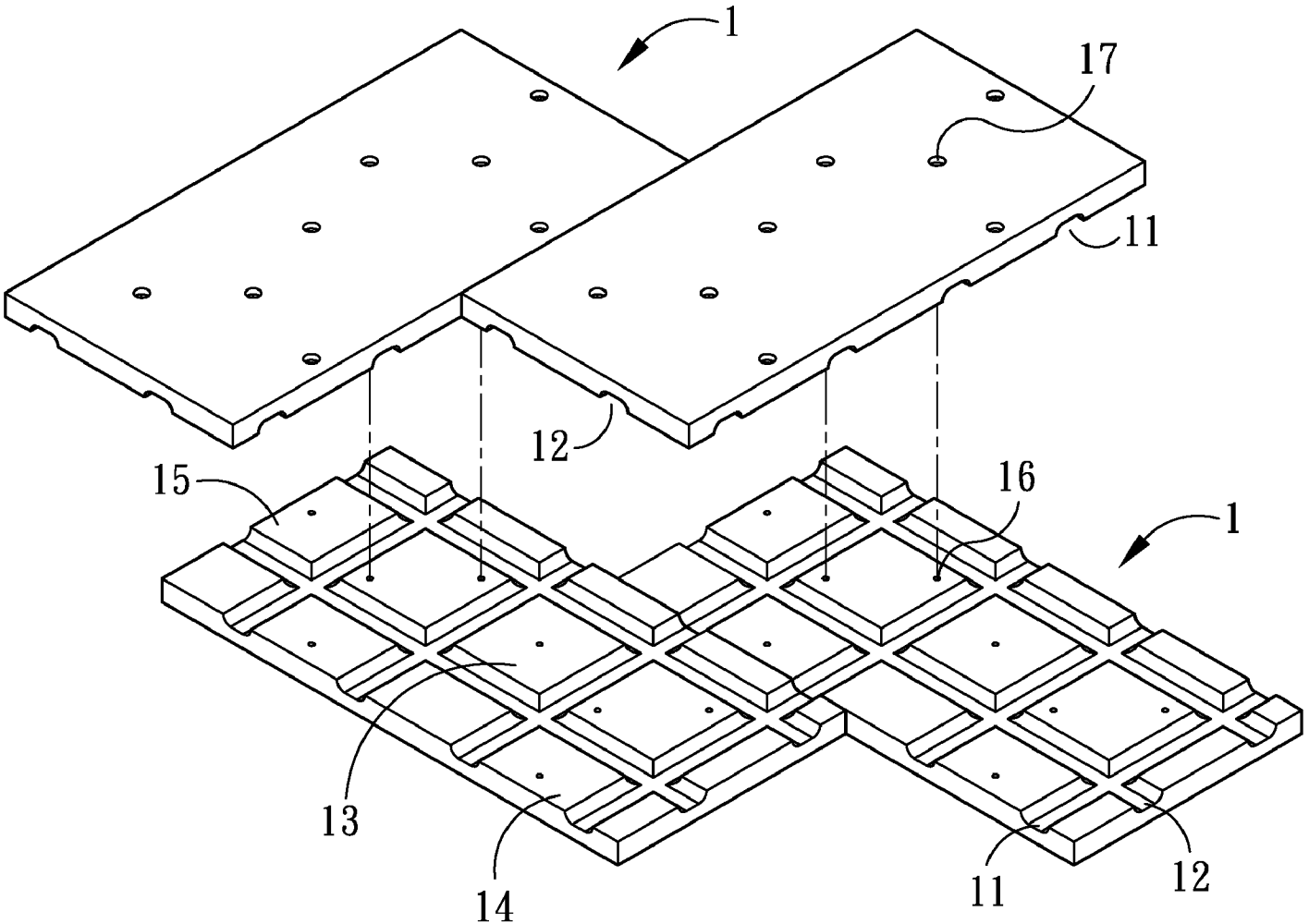
FIG. 3 is the pictorial exploded view of said first main body boards during butting of grooves.
Figure 4:
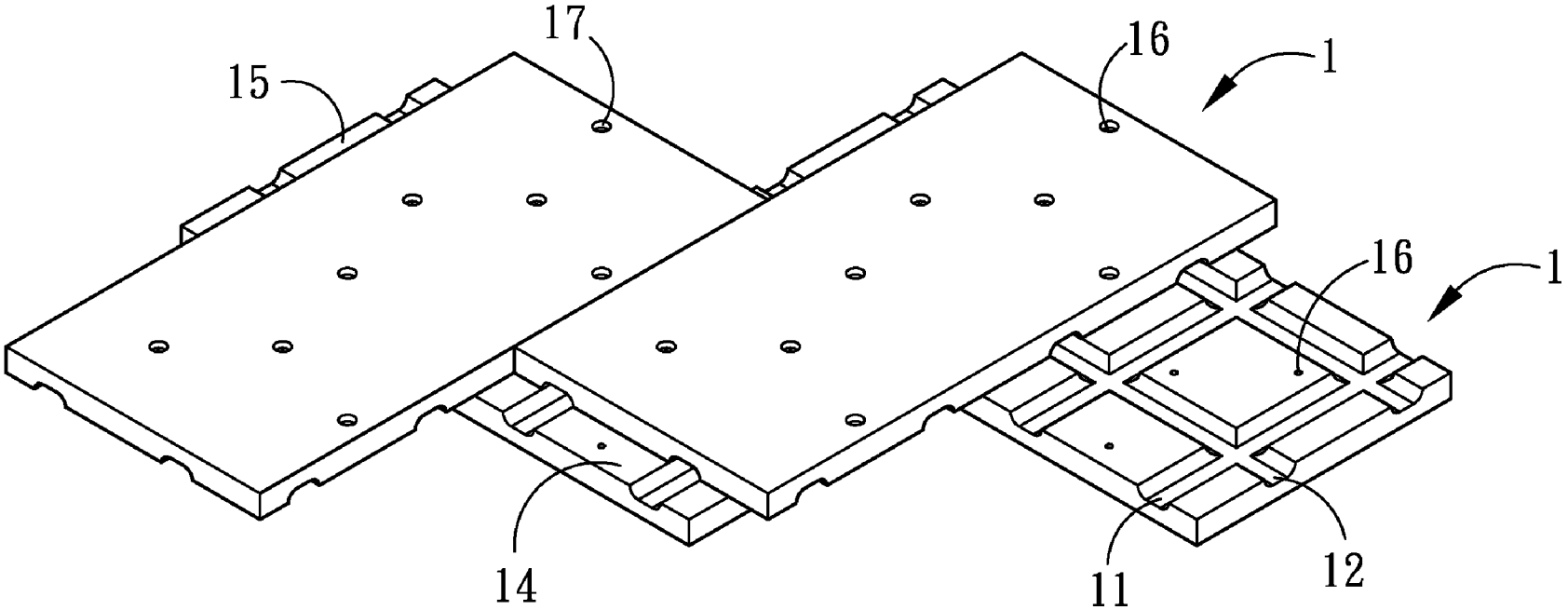
FIG. 4 is a pictorial assembly view of said first main body boards during butting of grooves.

Further, as shown in FIGS. 3 and 4, an equal width longitudinal splicing joining face 14 parallel to the first long side h1 is provided additionally on said first main body board 1 from said base angle θ at a distance of a fourth unit length s4, as well as an equal width transverse splicing joining face 15 parallel to the first short side w1 is provided from said base angle θ at a distance of a fourth unit length s4, in a manner that said equal width longitudinal and transverse splicing joining faces 14 and 15 overlap at the base angle θ. On the other hand, region formed by said equal width longitudinal and transverse splicing joining faces 14 and 15 and region formed at a distance of the second unit length s2 are allowed to overlap and share with each other. Namely, longitudinal and transverse splicing joining faces 14 and 15 are formed along the circumstance of said first main body board 1, while brace block 13 is formed within the inner side of the first main body board 1.

Furthermore, through holes 16 provide on parts of brace blocks and equal width longitudinal and transverse splicing joining faces 14 and 15 of said first main body board 1 and penetrate through the thickness of the first main body board 1. One or more through holes 16 can be provided on said same one brace block 13 or longitudinal and transverse splicing joining faces 14 and 15, and at the same time, a counter bore 17 is provided at the end of said through holes 16 at the opposite side to the longitudinal and transverse grooves 11 and 12. In case of screw-fastening, said counter bore 17 is used to hide the head of said screw in the first main body board 1 so as to keep a flat wall surface. Naturally, the alignment and intimate connection of through holes 16 and through holes 16 on said first main body board 1 can be done by way of nailing, riveting, screwing, binding and equivalent means, without limited to any way. Even, no through holes 16 is provided on said first main body board 1, but instead, after butting of two first main body boards 1, they can be fastened at suitable positions with self-tapping screw or through nailing.

In such configuration, by butting two first main body boards 1 with each other and laying continually, a useful partition wall panel can be formed. In practical operation, since operators can not inspect and hence assure the alignment of the longitudinal groove 11 and the transverse groove 12, specific arrangement of said through holes 16 has to be used to align specific through holes 16 on front and rear first main body boards 1 in order to assure the formation of a duct from longitudinal and transverse grooves 11 and 12 of two first main body boards 1. Under this circumstance, region formed by a distance of the second unit length s2 to one of said first main body boards 1 will overlap on longitudinal and transverse splicing joining faces 14 and 15 of the other first main body board 1, such that said longitudinal and transverse splicing joining faces 14 and 15 of these two first main body boards 1 expose outwardly. Consequently, butting of any two first main body boards 1 will result into formation of exposed longitudinal and transverse splicing joining faces 14 and 15 along their circumstance, in a manner to facilitate the subsequent jointing of the longitudinal and transverse splicing joining faces 14 and 15 of other first main body boards 1, and thereby produce a continual wall face composition.

Figure 5:
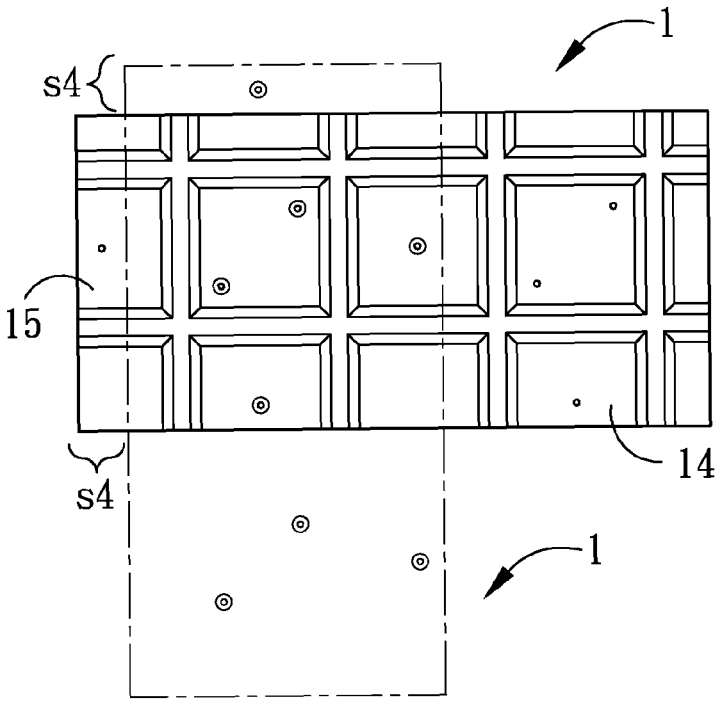
FIG. 5 is an illustrative plane view of said first main body board undergone assembly.
Figure 6:
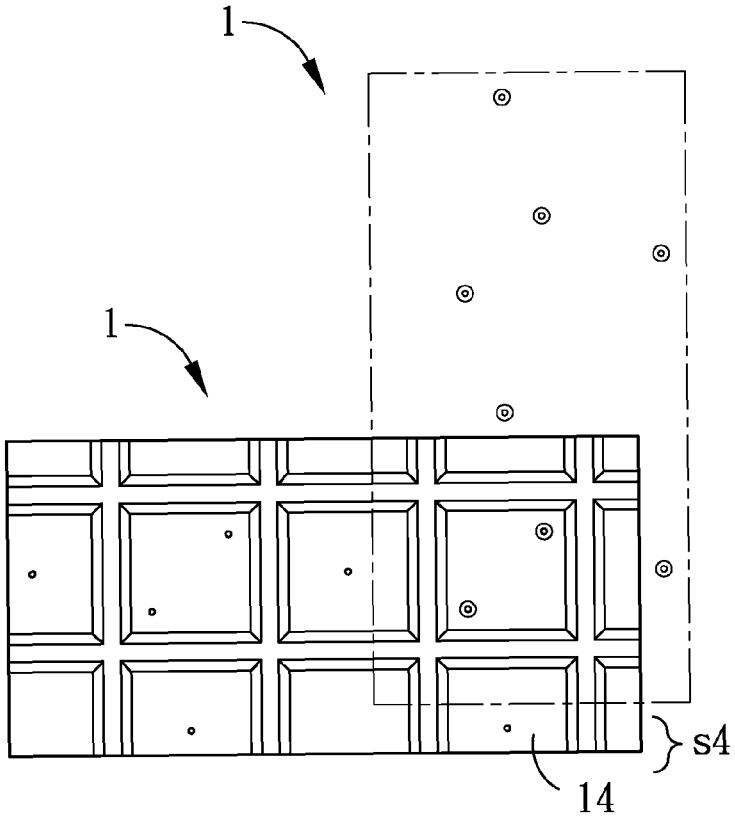
FIG. 6 is a second illustrative plane view of said main body board undergone assembly.
Figure 7:
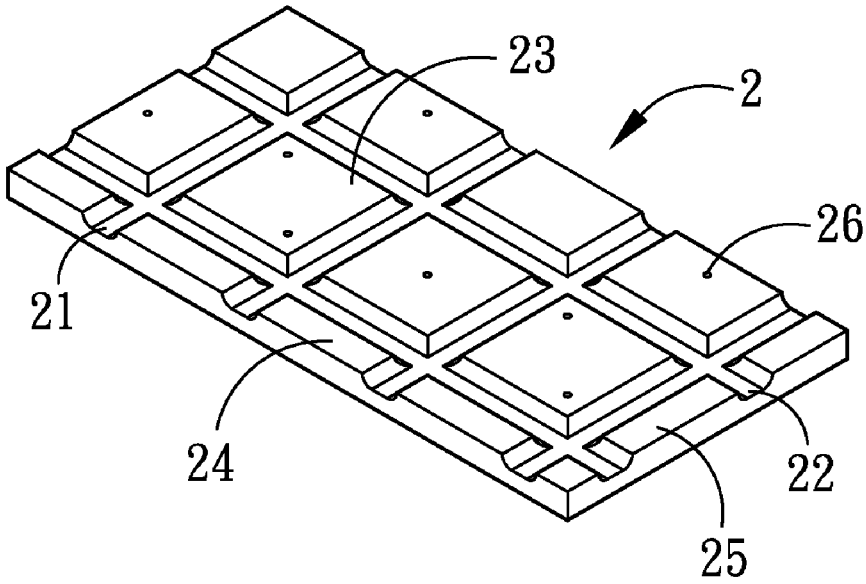
FIG. 7 is a pictorial view of the inventive second main body board.
Figure 8:
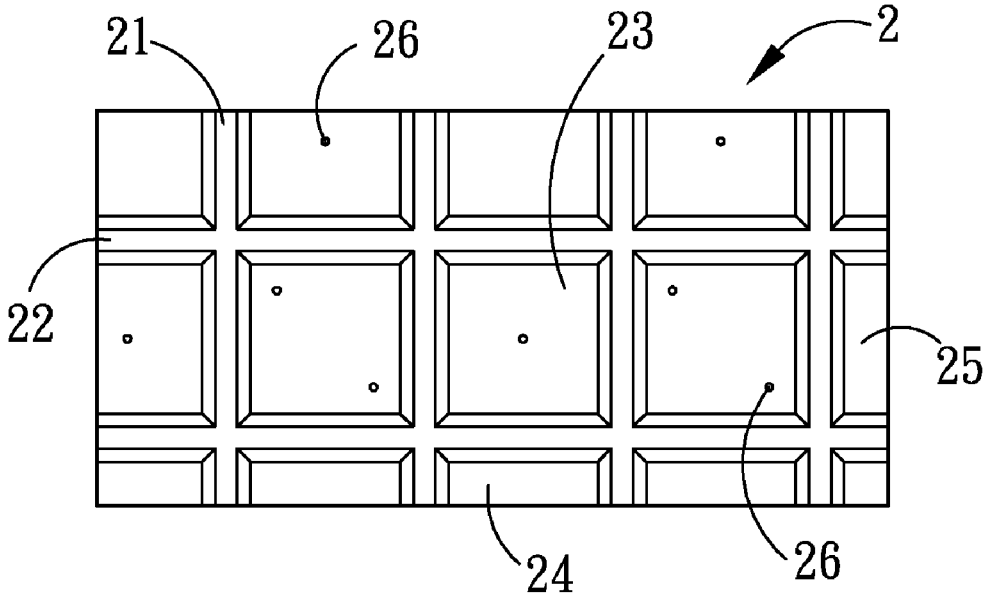
FIG. 8 is a plane view of said second main body board.
Figure 9:
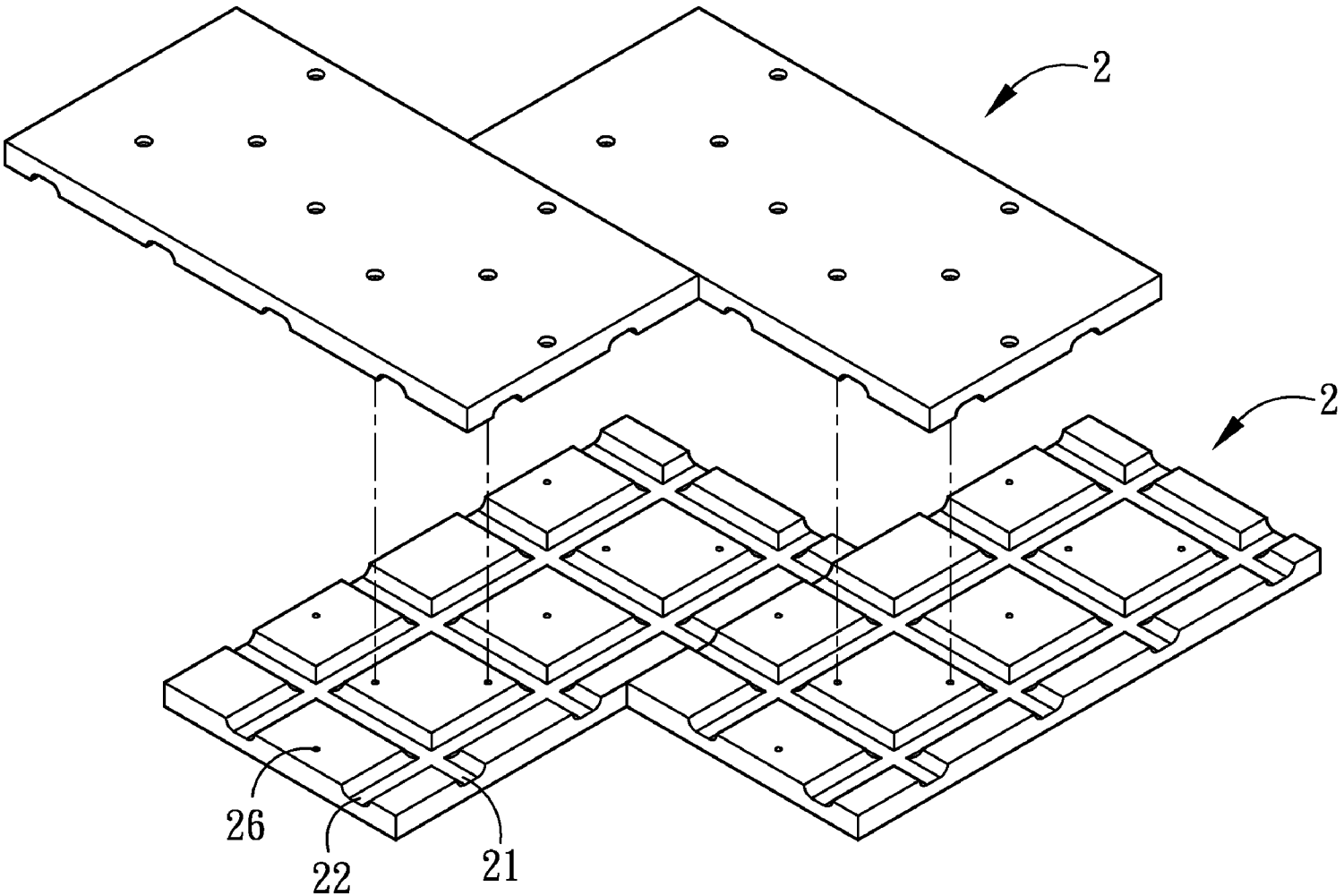
FIG. 9 is an exploded pictorial view of said second main body board undergone butting of grooves.
Figure 10:
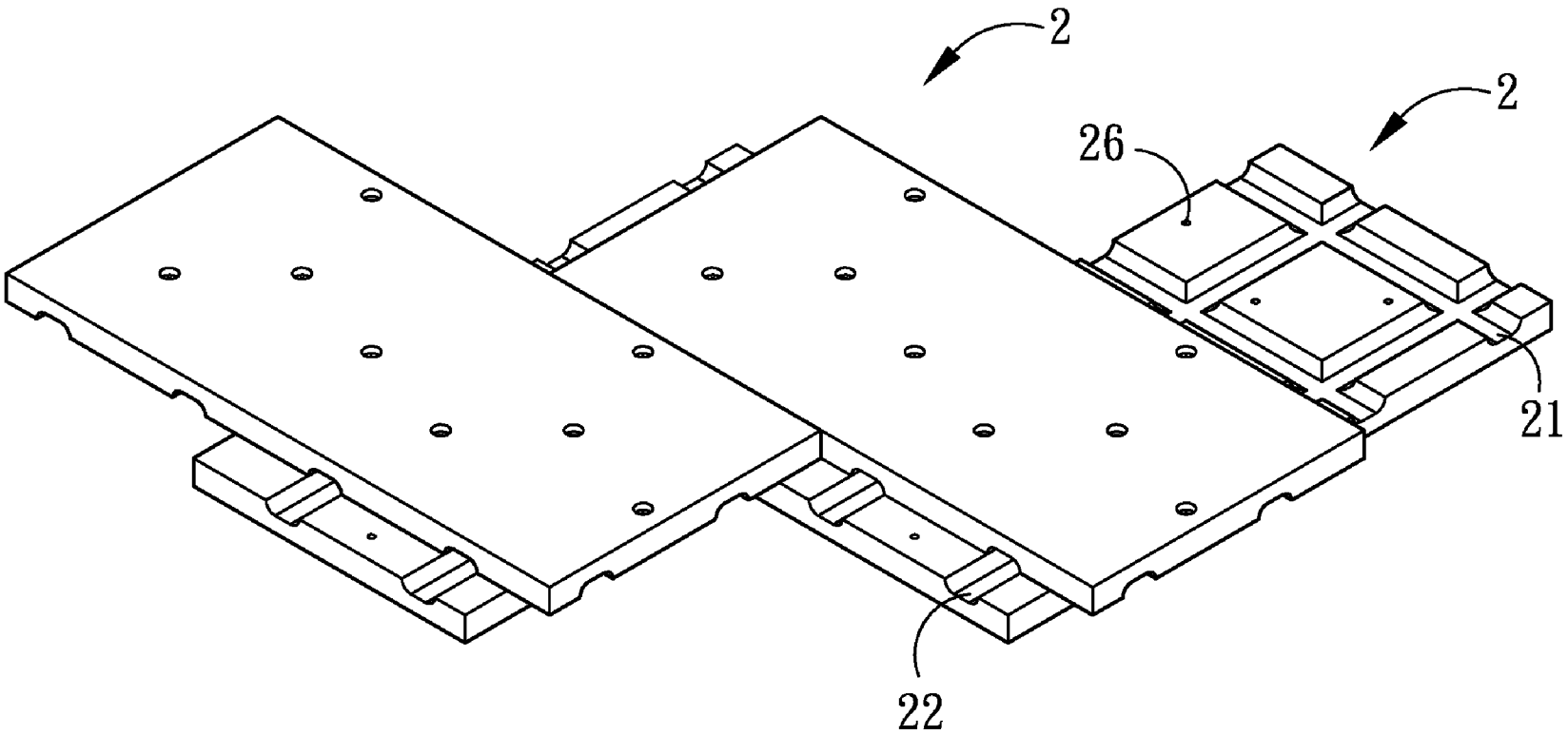
FIG. 10 is a pictorial assembly view of said second main body board undergone butting of grooves.
Figure 11:
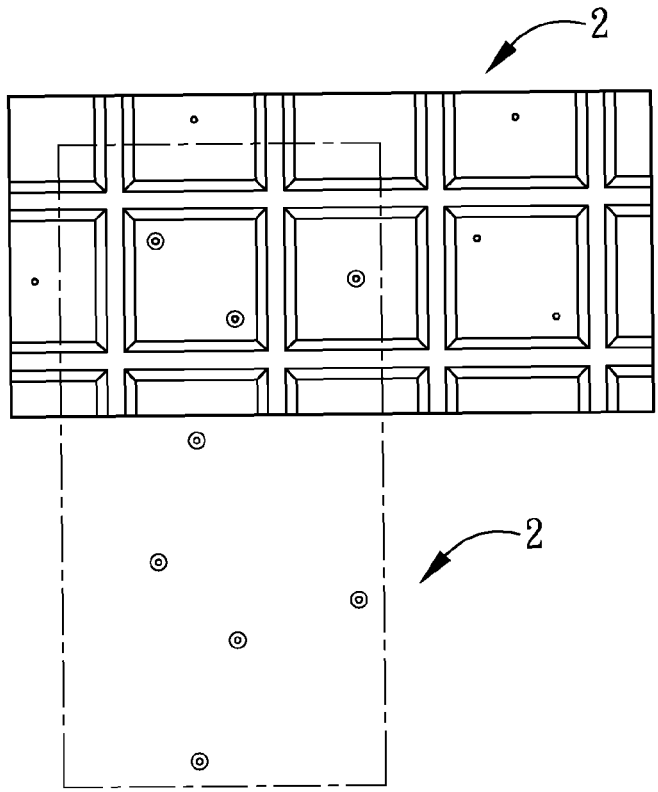
FIG. 11 is a first illustrative plane view of said second main body board undergone assembly.
Figure 12:
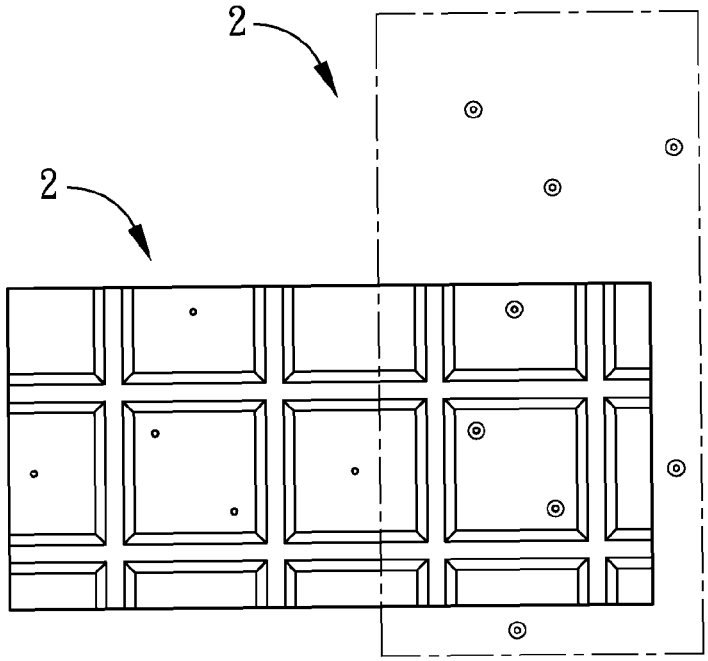
FIG. 12 is a second illustrative plane view of said second main body board undergone assembly.

Further, as shown in FIGS. 5 and 6, the partition wall panel formed independently with above-described first main body boards 1 is based on the base angle θ on said first main body boards 1, by attaching in the parallel direction of both sides of the angle opposite to the base angle θ on butted first main body boards 1. Moreover, there is a translational distance of a fourth unit length s4 or a distance of a fourth unit length s4 plus integral first unit length s1, in a manner that the brace block 13 of the first main body board 1 in the overlapped part can combine mutually with the brace block 13 of the other first main body board 1. As such, jointing of these two first main body boards 1 will result inevitably into a corresponding equal width longitudinal and transverse splicing joining faces 14 and 15, thereby through holes 16 of longitudinal and transverse splicing joining faces 14 and 15 on one of the first main body boards 1 will joint correspondingly and exactly with through holes 16 of the brace block 13 of the other first main body board 1 or with through holes 16 of longitudinal and transverse splicing joining faces 14 and 15. At the same time, through holes 16 of the brace block 13 on one first main body board 1 will joint correspondingly and exactly with through holes 16 on the brace block 13 or on the longitudinal and transverse splicing joining faces 14 and 15 of the other first main body board 1. The first unit length s1 of said first main body board 1 is greater than the second unit length s2, the second unit length s2 is greater than or equal to the third unit length s3. Further, the sum of the second unit length s2 and the third unit length s3 is less than or equal to the first unit length s1, and the second unit length s2 is greater than the fourth unit length s4, and so on. All of these are for making the region connected by the longitudinal and transverse splicing joining faces 14 and 15 of two neighboring first main body boards 1 equal to or somewhat less than the first unit length s1 of the brace block 13, thereby forming an entire continual wall face. Therefore, butting of said two first main body boards 1 has directivity.

Referring to FIG. 7 to 12, a second main body board 2 according to the invention is shown, wherein said second main body board 2 has a size same as the first main body board 1, and the second main body board 2 has each of its longitudinal and transverse grooves 21, 22, brace block 23, longitudinal and transverse splicing joining faces 24, 25, and through holes 26 deposited in mirror symmetry to those of the first main body board 1, respectively.

Consequently, said second main body board 2 has same function as the above-described first main body board 1, and hence no further description will be provided herein.

Figure 13:
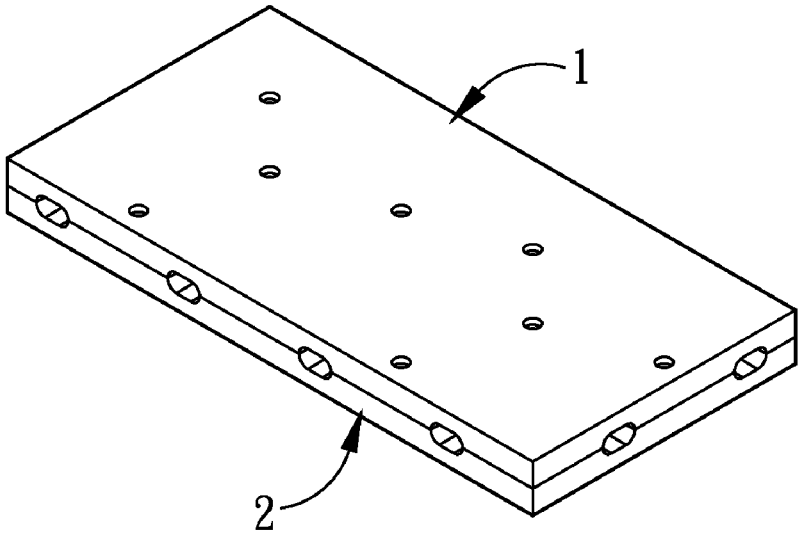
FIG. 13 is a mirror symmetrical referenced pictorial view of the inventive first and second main body boards.
Figure 14:
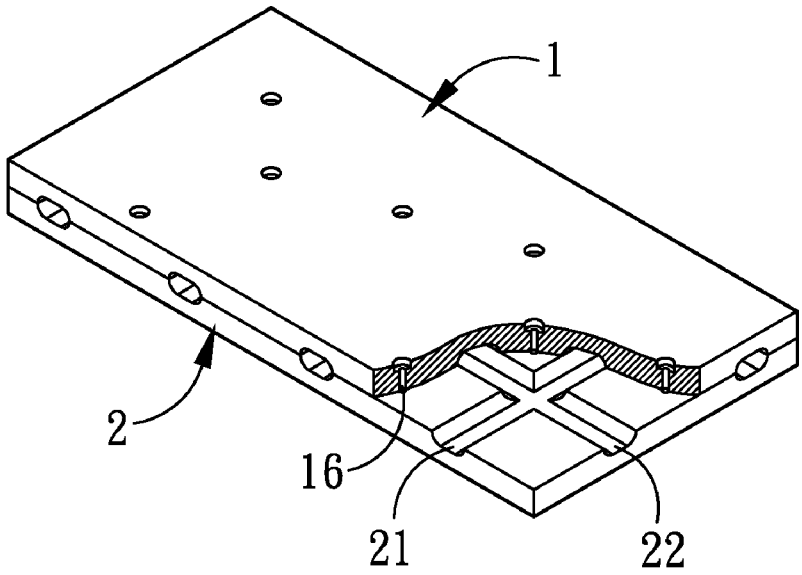
FIG. 14 is a mirror symmetrical referenced pictorial part sectional view of said first and second main body boards.
Figure 15:
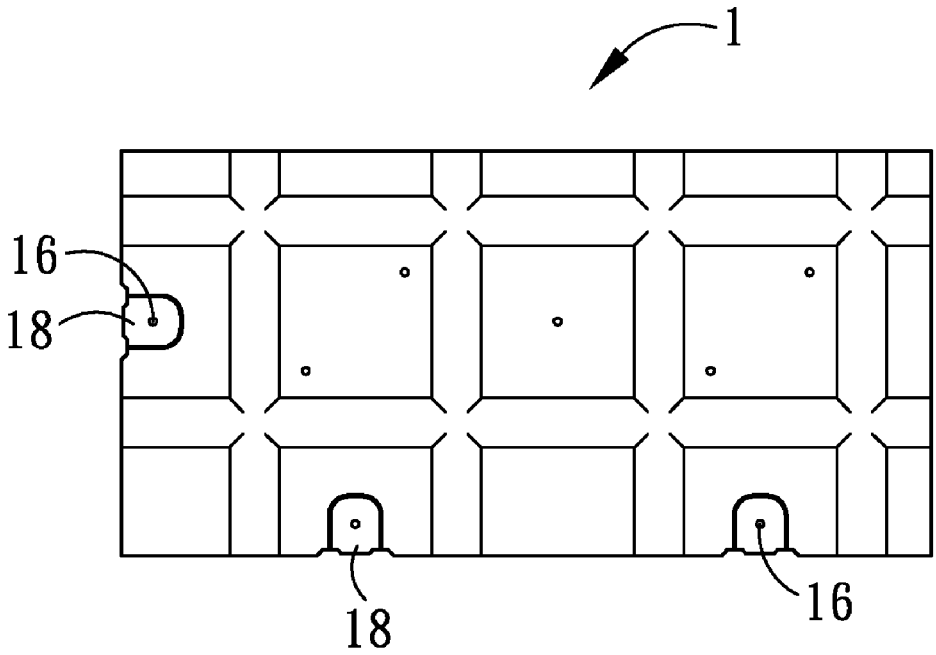
FIG. 15 is a plane view of the structure of depressed blocks on said first main body board.
Figure 16:
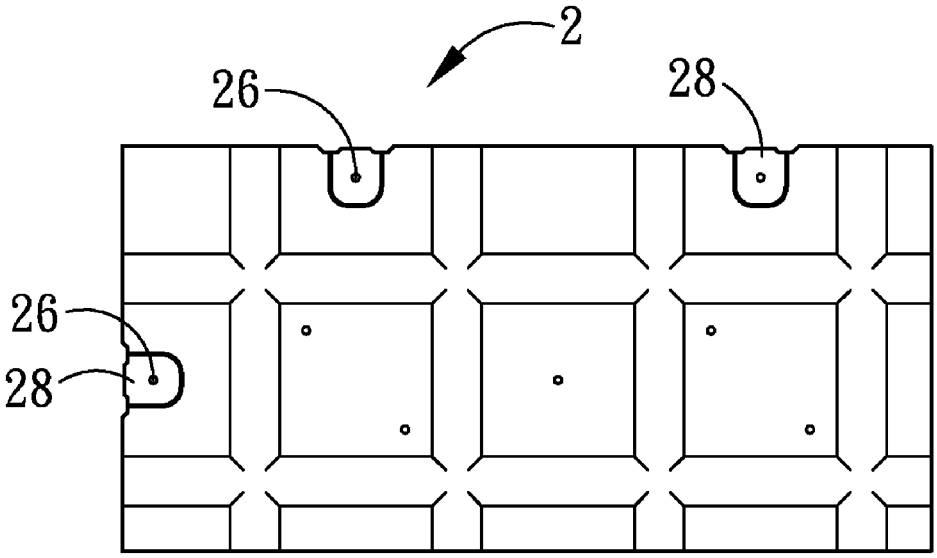
FIG. 16 is a plane view of the depressed block structure on said second main body board.
Figure 17:
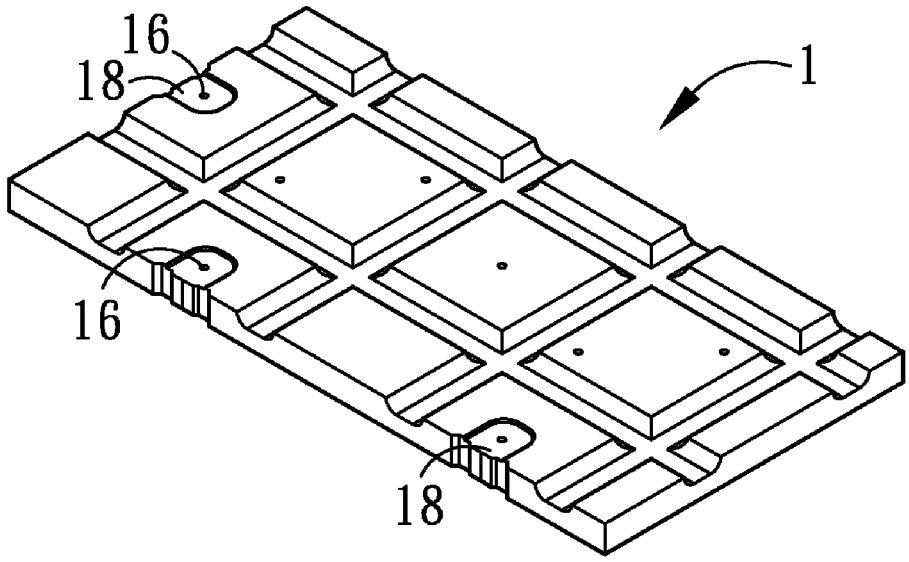
FIG. 17 is a pictorial view of the depressed block structure on said first main body board.
Figure 18:
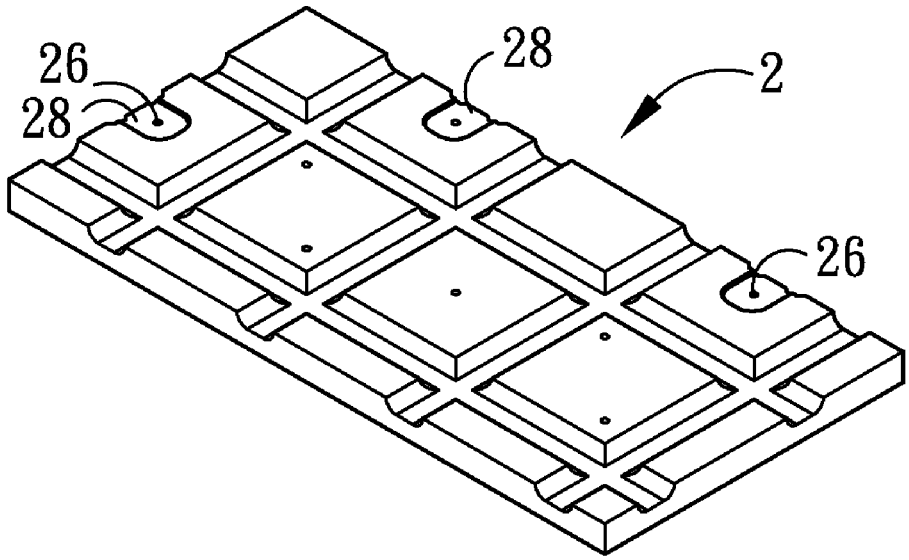
FIG. 18 is a pictorial view of the depressed block structure on said second main body board.
Figure 19:
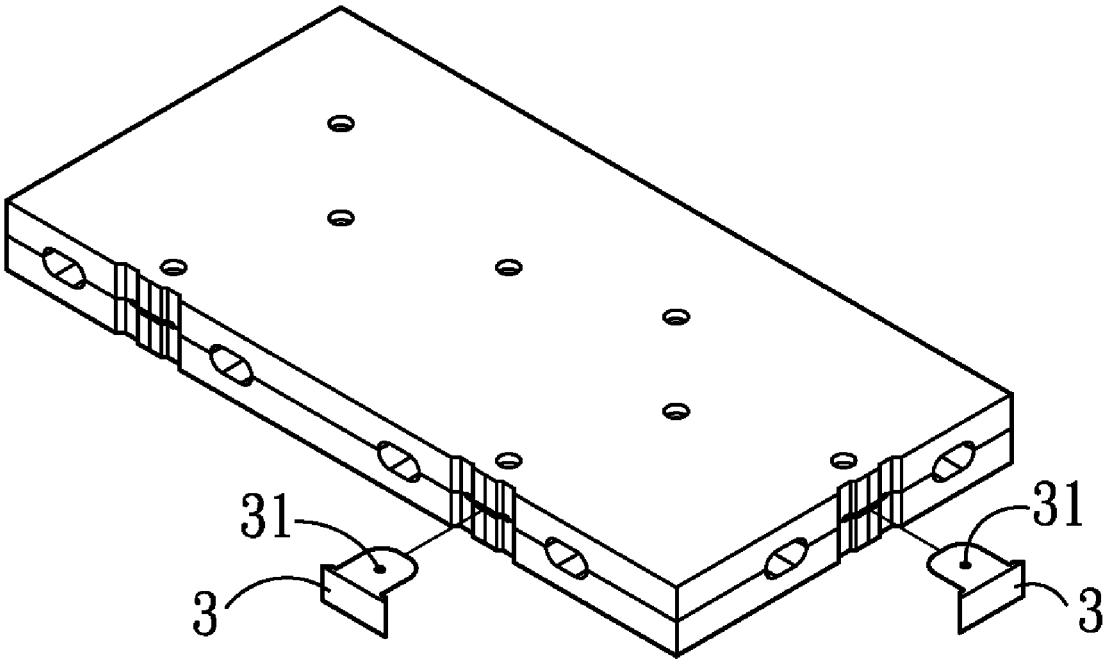
FIG. 19 is a pictorial assembly view of said mutually-combined first and second main body boards having depressed blocks.
Figure 20:
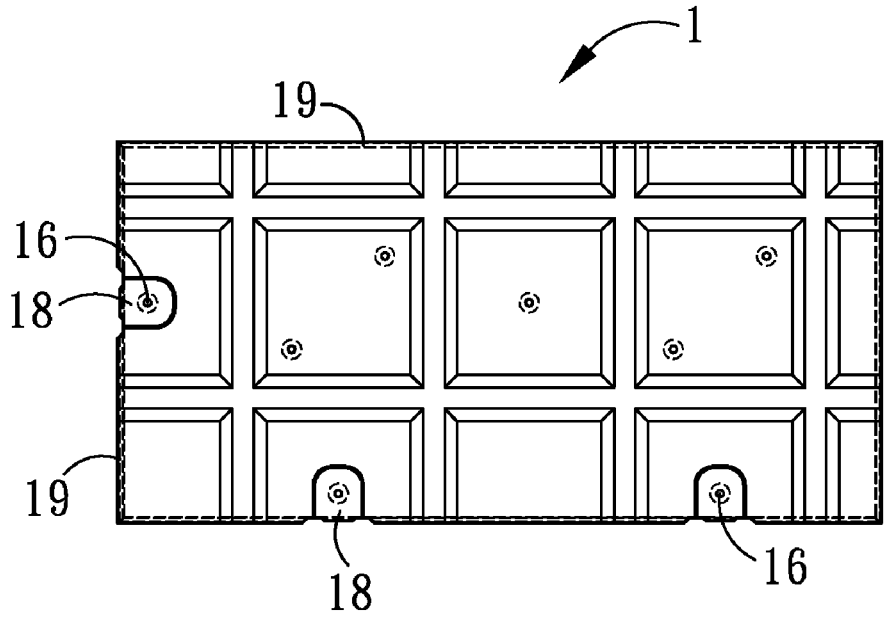
FIG. 20 is a plane view of a reinforcing groove structure in the first main body board.
Figure 21:
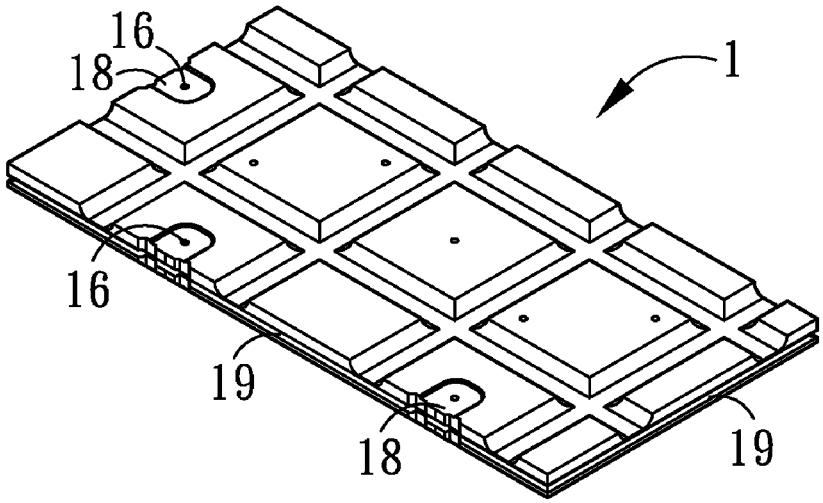
FIG. 21 is a pictorial view of the reinforcing groove in the first main body board.
Figure 22:
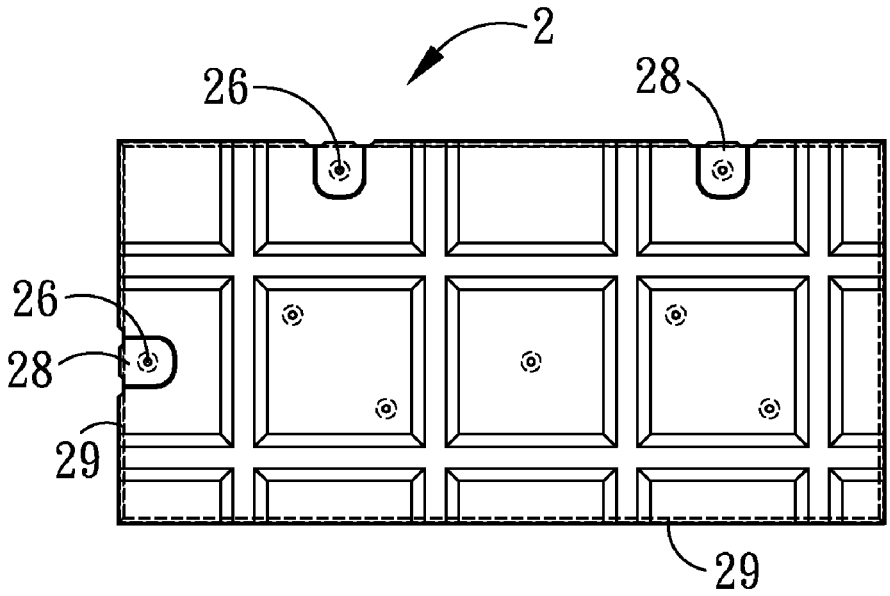
FIG. 22 is a plane view of a reinforcing groove structure in the second main body board.
Figure 23:
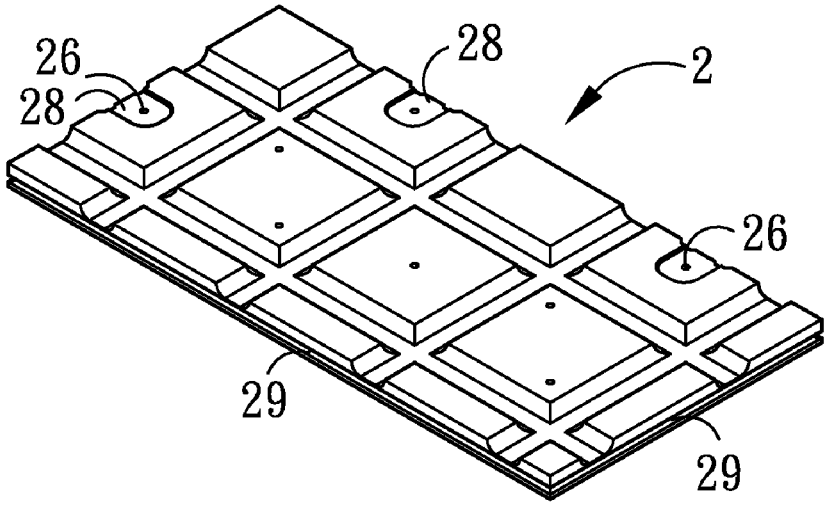
FIG. 23 is a pictorial view of the reinforcing groove in the second main body board.

Furthermore, as shown in FIGS. 13 and 14, the partition wall panel according to the invention can be formed with one first main body board 1 and one second main body board 2 by attaching the base angle θ on said first main body board 1 on both sides of the angle opposite to the base angle of the butted second main body board 2 in parallel direction and translated respectively a distance of a fourth unit length s4 or a distance of a fourth unit length s4 plus an integral first unit length s1, thereby the brace block 13 of the first main body board 1 in the overlapped part will combine with the brace block 23 of the second main body board 2 mutually. Under this situation, through holes 16 on the brace block 13 of the first main body board 1 will joint correspondingly and exactly with through holes 26 on the brace block 23 or longitudinal and transverse splicing joining faces 24, 25 of the second main body board 2.

Referring to FIG. 15 to 19, said first main body board 1 and second main body board 2 are provided further on their longitudinal splicing joining faces 14, 24 and transverse splicing joining faces 15, 25 in the direction of said respective joining face with depressed blocks 18, 28. Said depressed blocks 18, 28 are present roughly as a rectangular solid, whose area can cover not only the surroundings of longitudinal splicing joining faces 14, 24 and transverse splicing joining faces 15, 25 having through holes 16, 26, but also extend over edges of neighboring first and second main body boards 1, 2, as well as penetrate downwardly through the thickness of the first and second main body boards 1, 2, thereby an L-shaped jointing steel sheet 3 can be inserted therein, wherein said L-shaped jointing steel sheet 3 has via 31 in communication with through holes 16, 26 to facilitate the penetration and fastening with screws.

Referring to FIG. 20 to FIG. 23, said first main body board 1 is provided on the surface in the direction of the thickness with a rectangular reinforcing groove 19 surrounding the first main body board 1. Also, said second main body board 2 is provided on the surface in the direction of the thickness with a rectangular reinforcing groove 29 surrounding the second main body board 2. Said reinforcing grooves 19, 29 are used to provide therein with reinforcing means such as reinforcing steel bars in order to strengthen the wall panel structure, wherein said reinforcing grooves 19, 29 are provided at bottoms thereof with a slant or a semi-circular lead angle.

By way of the foregoing, the combined wall panel according to the invention has following advantages over conventional techniques:

1. The main body board in the combined wall panel according to the invention can be mass produced in a plant, and then a demanded amount of main body boards are transported to the working place and assembled there, whereby the process is simple and fast, operators can carry out their work after receiving merely a simple training, and therefore, the cost for personal training is lower.

2. The combined wall panel according to the invention can be finished just through in situ assembly and combination, and therefore, can increase the speed for constructing partition to an extent higher than that for conventional partition working, thereby can lower both of working cost and time cost.

3. The finished combined wall panel according to the invention has a flat surface, all pipes and lines can be embedded within the inner ducts, and further, during repairing, only few main body boards are needed to be removed without altering the entire wall panel.

Many changes and modifications in the above-described embodiment of the invention can, of course, be carried out without departing from the scope thereof. Accordingly, to promote the progress in science and useful arts, the invention is disclosed and is intended to be limited only by the scope of the appended claims.

What is claimed is:

1. A combined wall panel, formed by lap jointing continually a plurality of main body boards, characterized in that:

said main body board comprising a rectangular solid in which its length is integral times to its width, and its width is greater than its thickness; wherein said main body board assigns its one angle as a base angle, said base angle is associated with a first long side and a first short side, and a second long side and a second short side are provided on the edges of said main body board opposite to said first long side and first short side; a plurality of longitudinal grooves parallel to said short side are provided from said base angle along said first long side, and a plurality of transverse grooves parallel to the long side are provided from said base angle along said first short side, in a manner that said longitudinal grooves and transverse grooves are perpendicular and intersected with one another, as well as said longitudinal grooves and transverse grooves penetrate the periphery of said main body board, respectively;

wherein said first longitudinal groove is provided from said base angle at a translational distance of a second unit length to said first short side, and remanding longitudinal grooves are provided successively from said first longitudinal groove at an equal interval of a first unit length, while the last longitudinal groove is positioned at a distance of a third unit length to a second short side; a first transverse groove is provided from said base angle at a translational distance of said second unit length to the first long side, remanding transverse grooves are provided successively from said first transverse groove at an equal interval of said first unit length, while the last transverse groove is positioned at a distance of said third unit length to a second long side;

wherein a protruding square brace block surrounded by said longitudinal groove and transverse groove is formed on said main body board;

wherein an equal width longitudinal splicing joining face parallel to said first long side and having a fourth unit width is provided further from said base angle on said main body board, and an equal width transverse splicing joining face parallel to said first short side and having a fourth unit length is provided further from said base angle, in a manner that said equal width longitudinal and transverse splicing joining faces are overlapped at the position of said base angle; wherein region of said equal width longitudinal and transverse splicing joining faces is overlapped and shared with a region formed by the second unit width;

wherein said main body board is classified into two types of a first main body board and a second main body board, said two types of main body boards have a same size, each of their longitudinal and transverse grooves, brace block, longitudinal and transverse splicing joining faces, and through holes are arranged in mirror symmetry to each other, respectively; and wherein butting and combination of said main body boards are carried out with two said first main body boards or two said second main body boards by aligning and fixing specific through holes on said two main body boards, in a manner that said longitudinal and transverse grooves of said two main body boards form ducts, wherein a region formed by the second unit width of one of these two main body boards will overlap onto the longitudinal and transverse splicing joining faces of other main body board, thereby longitudinal and transverse splicing joining faces of said two main body board will expose outside to facilitate the formation of a continual wall face.

2. A combined wall panel as recited in claim 1, wherein said main body board is provided further in part of said brace block and said equal width longitudinal and transverse splicing joining faces with through holes penetrating through the thickness of said main body board.

3. A combined wall panel as recited in claim 1, wherein said main body boards are provided on the surface in the direction of thickness with rectangular reinforcing grooves surrounding said main body boards, wherein said reinforcing grooves are provided at bottoms thereof with a slant or a semi-circular lead angle.

4. A combined wall panel as recited in claim 2, wherein said main body board is classified into two types of a first main body board and a second main body board, said two types of main body boards have a same size, each of their longitudinal and transverse grooves, brace block, longitudinal and transverse splicing joining faces, and through holes are arranged in mirror symmetry to each other, respectively.

5. A combined wall panel as recited in claim 2, wherein said main body boards are provided on the surface in the direction of thickness with rectangular reinforcing grooves surrounding said main body boards, wherein said reinforcing grooves are provided at bottoms thereof with a slant or a semi-circular lead angle.

6. A combined wall panel as recited in claim 4, wherein butting and combination of said main body boards are carried out with two said first main body boards or two said second main body boards by aligning and fixing specific through holes on said two main body boards, in a manner that said longitudinal and transverse grooves of said two main body boards form ducts, wherein a region formed by the second unit width of one of these two main body boards will overlap onto the longitudinal and transverse splicing joining faces of other main body board, thereby longitudinal and transverse splicing joining faces of said two main body board will expose outside to facilitate the formation of a continual wall face.

7. A combined wall panel as recited in claim 1, wherein the first unit length is greater than the second unit length, the second unit length is greater than or equal to the third unit length; the sum of the second unit length plus the third unit length is less than or equal to the first unit length; and the second unit length is greater than the fourth unit length.

8. A combined wall panel as recited in claim 1, wherein butting and combination of said main body boards are carried out with one said first main body board and one said second main body boards by aligning and fixing specific through holes on said two main body boards, in a manner that said longitudinal and transverse grooves of said two main body boards form ducts.

9. A combined wall panel as recited in claim 4, wherein butting and combination of said main body boards are carried out with one said first main body board and one said second main body boards by aligning and fixing specific through holes on said two main body boards, in a manner that said longitudinal and transverse grooves of said two main body boards form ducts.

10. A combined wall panel as recited in claim 2, wherein more than one of said brace block, longitudinal splicing joining face, through hole of transverse splicing joining face are provided such that through holes on two main body boards are aligned during butting of two main body boards.

11. A combined wall panel as recited in claim 2, wherein a butting and intimate jointing of through hole to through hole of said brace block, longitudinal splicing joining faces, and through holes of transverse splicing joining faces is carried out through nailing, riveting, screwing, binding and equivalent means.

12. A combined wall panel as recited in claim 1, wherein the bottoms of said longitudinal and transverse grooves are present as a slant or a semi-circular lead angle.

13. A combined wall panel as recited in claim 2, wherein said brace block, longitudinal splicing joining face, and through holes of transverse splicing joining face are provided further with a counter bore on the face opposite to said groove.

14. A combined wall panel as recited in claim 1, wherein said longitudinal and transverse splicing joining face are provided in the direction of said respective joining face with depressed blocks, wherein said blocks are present roughly as a rectangular solid with its area covers surroundings of sites having through holes on said joining faces, and it extends to edges of neighboring main body board, as well as penetrates downwardly through the thickness of said main body board, so as to facilitate the insertion of an L-shaped jointing steel sheet therein.

15. A combined wall panel as recited in claim 2, wherein said longitudinal and transverse splicing joining face are provided in the direction of said respective joining face with depressed blocks, wherein said blocks are present roughly as a rectangular solid with its area covers surroundings of sites having through holes on said joining faces, and it extends to edges of neighboring main body board, as well as penetrates downwardly through the thickness of said main body board, so as to facilitate the insertion of an L-shaped jointing steel sheet therein.

* * * * *